US006536856B2

(12) United States Patent
Pelizzari et al.

(10) Patent No.: US 6,536,856 B2
(45) Date of Patent: Mar. 25, 2003

(54) DOOR FOR BUILT-IN HOUSEHOLD ELECTRICAL APPLIANCES

(75) Inventors: Armando Pelizzari, Ternate (IT); Andrea Ansaldo, Arcisate (IT); Matteo Reni, Busto Arsizio (IT); Giorgio Giudici, Lonate Pozzolo (IT)

(73) Assignee: Whirlpool Corporation, Benton Harbor, MI (US)

( * ) Notice: Subject to any disclaimer, the term of this patent is extended or adjusted under 35 U.S.C. 154(b) by 21 days.

(21) Appl. No.: 09/867,121

(22) Filed: May 29, 2001

(65) Prior Publication Data

US 2001/0047565 A1 Dec. 6, 2001

(30) Foreign Application Priority Data

May 30, 2000 (IT) ..... MI00A1191

(51) Int. Cl.[7] ..... E06B 3/00; A47B 77/08

(52) U.S. Cl. ..... 312/204; 312/265.5; 248/287.1

(58) Field of Search ..... 52/717.01, 208, 52/784.14, 506.02, 506.04; 248/287.1, 275.11, 913; 49/463, 465, 70; 312/204, 228, 236, 265.5, 265.6, 327, 328, 311

(56) References Cited

U.S. PATENT DOCUMENTS

| | | | | |
|---|---|---|---|---|
| 2,244,432 A | * | 6/1941 | Schwab | |
| 3,728,751 A | * | 4/1973 | Nes | 412/19 |
| 3,866,994 A | | 2/1975 | Bonin | |
| 4,732,431 A | * | 3/1988 | Mason | 312/109 |
| 4,765,697 A | | 8/1988 | Gardell et al. | |
| 5,172,504 A | * | 12/1992 | De Maat et al. | 40/605 |
| 5,571,276 A | * | 11/1996 | Kobos et al. | 312/109 |

FOREIGN PATENT DOCUMENTS

| | | | |
|---|---|---|---|
| EP | 168672 | * | 6/1985 |
| EP | 873704 | * | 10/1988 |
| EP | 0647821 A1 | | 4/1995 |
| EP | 0718459 A2 | | 6/1996 |
| FR | 2655666 | | 6/1991 |
| GB | 844819 | | 8/1960 |
| GB | 2189136 A | | 10/1987 |
| GB | 2238576 | * | 6/1991 |

* cited by examiner

*Primary Examiner*—Janet M. Wilkens
(74) *Attorney, Agent, or Firm*—Robert O. Rice; Thomas J. Roth; Stephen D. Krefman

(57) ABSTRACT

A moulded copolymer door for built-in household electrical appliances to which a panel is to be adjustably connected to the door. The panel is configured to be adjusted in height, laterally and in depth. Adjustable mounting brackets are mounted on the door adjacent to undercuts on the vertical sides of said door and are accessible from a face of the door opposite of the panel through which the undercuts of the panel may be secured to the adjustable mounting brackets.

17 Claims, 2 Drawing Sheets

DOOR FOR BUILT-IN HOUSEHOLD ELECTRICAL APPLIANCES

BACKGROUND OF THE INVENTION

1. Field of the Invention

The present invention relates to a door for built-in household electrical appliances to which a panel is to be connected by means which enable the panel to be adjusted in height, laterally and in depth so that the door, including the panel, matches adjacent cabinets or furniture housings that are adjacent to and/or receive the appliance.

2. Description of the Related Art

In known doors, two examples of which are described in EP0 168 672 A2 and EP 0 873 704 A1, adjustable fitting elements are provided for mounting a panel to an appliance door. The fitting elements serve to secure and align the door panel relative to the door.

SUMMARY OF THE INVENTION

An object of the present invention is to substantially simplify the operations involved in mounting and adjusting the position of a panel to a door using adjustable mounting brackets.

DESCRIPTION OF THE INVENTION

Figure 1:
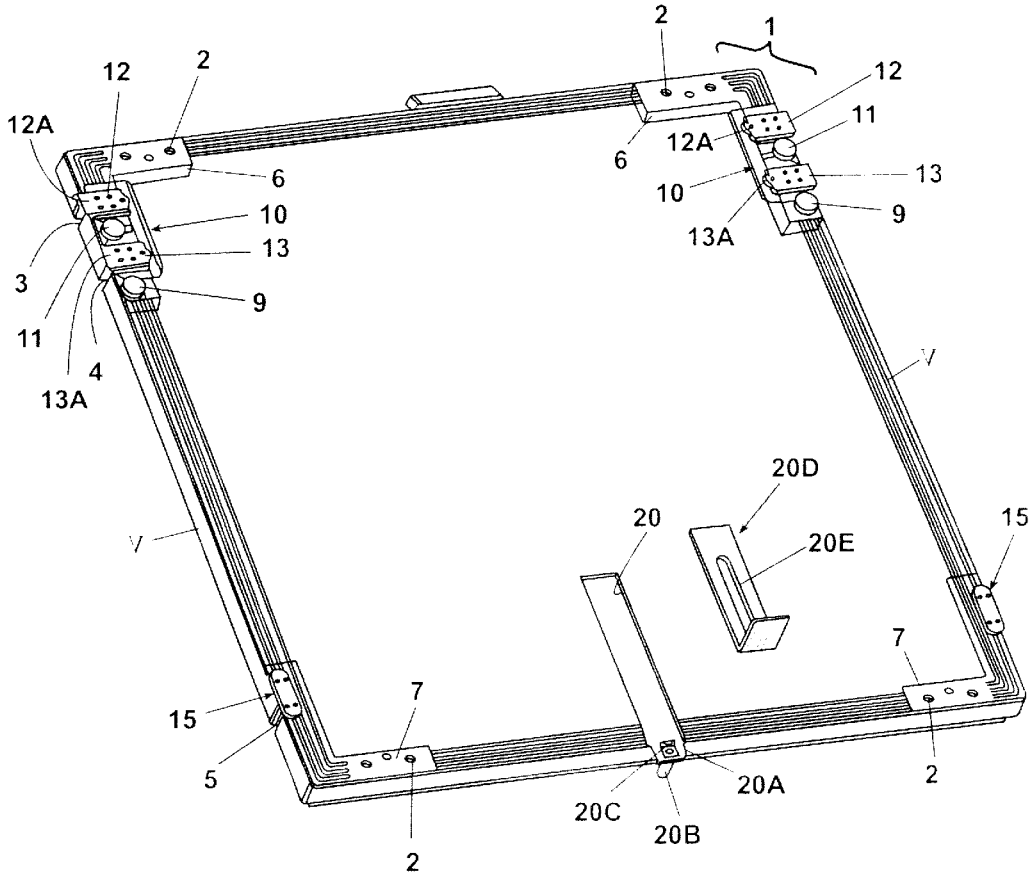
FIG. 1 is a schematic perspective view of a door according to the invention.

In the figures, the reference numeral 1 indicates the door of a built-in household electrical appliance, for example a refrigerator. The door may be constructed by injecting a polymer material, for example polystyrene, into a mould. As this embodiment concerns a refrigerator door, it includes upper and lower left and right groups of holes 2 for applying conventional hinges. In addition, lateral undercuts are provided along the vertical sides V of the door. Two undercuts 3, 4 are provided in the upper part of the sides V and, in the embodiment of FIG. 1, a single undercut 5 in the lower part.

Considering the relatively low mechanical strength of some polymer materials that can be used (for example polystyrene), reinforcement elements may be co-moulded at the corners. These reinforcement elements, which may be constructed of an engineered polymer, are indicated schematically by dashed lines, the upper of which are indicated by the reference numeral 6 and the lower by 7. The reinforcement elements 6, 7 can be arranged to enable door hinges to be attached by conventional hinge screws. In addition, reinforcement elements 6, 7 can be arranged to provide seats for adjustable mounting brackets for adjustably mounting a door cover panel 8 (see FIG. 3) to door 1. It will be appreciated by one skilled in the art that separate reinforcement elements can be provided for the adjustable mounting brackets if desired. Typically it is desired to have panel 8 match, not only by appearance and dimensions but also by position, the cabinet or furniture units surrounding the recess into which the household electrical appliance is built. The adjustable mounting brackets can be of the known screw and cam type or other types of known adjustable mounting brackets. The adjustable mounting fittings disclosed in EP 0 168 672 A2 and EP 0 873 704 A1 are two examples of known adjustable mounting brackets. Typically, three adjustable mounting brackets are used, although more than three brackets may be used when desired. In the embodiment shown in FIG. 1, bracket 10 is provided with one adjusting screw serves for vertically adjusting the panel 8 which may comprise a cam 9 cooperating with the lower edge of adjustment bracket 10. Bracket 10 also includes a second adjusting screw that operates with its head 11 rotatably connected to adjustable mounting bracket 10 to move bracket 10, and accordingly panel 8, toward or away from door 1 as the screw is turned and thus enables the distance between the panel 8 and door 1 to be adjusted.

In the embodiment of FIG. 1 the adjustable mounting bracket 10 includes two pads 12, 13 provided with double-sided adhesive tape and with holes to enable panel 8 to be secured to adjustable mounting brackets 10 by screws.

Typically two of these holes, indicated by 12A and 13A, are used to secure panel 8 to adjustable mounting brackets 10 and hence to door 1. The arrangement of the assembly is such that holes 12A and 13A are aligned with the undercuts 3 and 4, thus enabling the operations involved in mounting and adjusting the panel 8 to be considerably simplified, as described hereinafter.

Figure 2A:
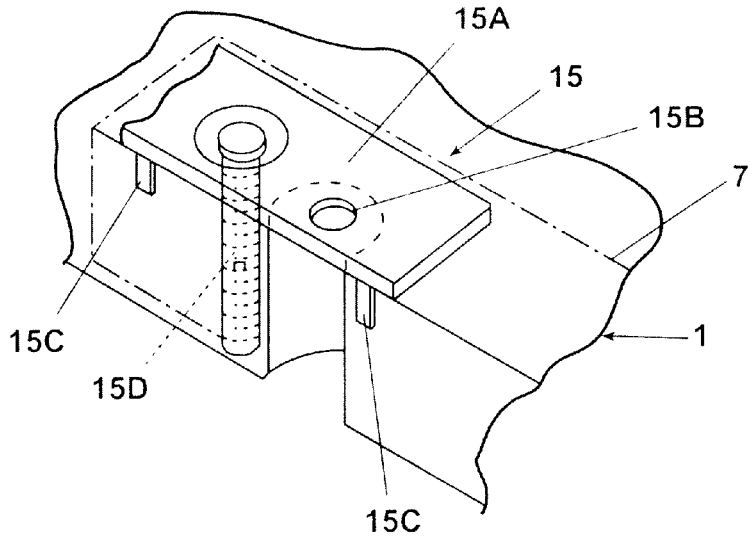
FIGS. 2A and 2B are respectively a partial perspective and partial sectional view showing schematically in greater detail a lower adjustable mounting bracket for adjusting the distance between the panel and the door.
Figure 2B:
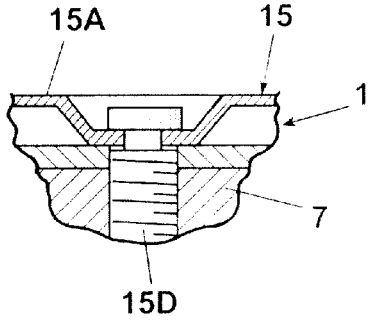
Figure 3:
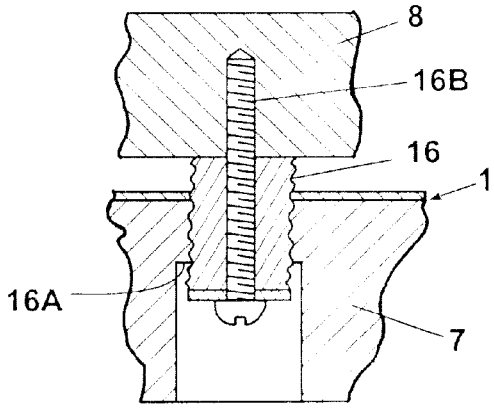
FIG. 3 is a section through another embodiment of a lower adjustable mounting bracket.

The panel mounting and adjustment means can also include one or two lower adjustable mounting brackets, one per side when two lower brackets are employed, indicated by 15 (in the embodiment of FIGS. 1, 2A and 2B) and by 16 (in the embodiment of FIG. 3).

In this embodiment the lower adjustable mounting brackets 15 and 16 are used to adjust only the distance between the panel and the door 1. The adjustable mounting brackets 15 comprise a plate 15A, with holes, typically only one of which is used to secure the panel 8 to adjustable mounting bracket 15 and hence to door 1. A mounting screw hole is indicated by 15B and is aligned with the undercut 5 to enable easy and rapid securing of the panel 8 to door 1. The adjustable mounting bracket plate 15A comprises anti-rotation tabs 15C arranged to bear against the door edge. A threaded hole is provided in the corner reinforcement 7 in which a screw 15D is rotatably mounted. Plate 15A is connected to screw 15D (see detail of FIG. 2B) so that screw 15D can rotate in reinforcement 7. When screw 15D is rotated by, such as by a screwdriver, the plate 1 5A, and hence panel 8, are moved axially relative to the door. Alternatively the screw 15D and the plate 15A can be rigidly joined together and tabs 15C eliminated, in which case the adjustment can be made in discrete steps (every half turn of the screw 15D) by rotating screw 15D.

In the embodiment of the lower adjustable mounting bracket shown in FIG. 3, and indicated by 16, the reinforcement 7 includes a hole. An axially bored setscrew 16A with a notch enabling it to be screwed into a suitable threaded hole in reinforcement 7. The threaded setscrew bears against the panel 8 so that as the setscrew is rotated the distance between the panel and door can be adjusted. After the position of the panel is adjusted by use of setscrew 16A, the panel can be secured to reinforcement 7 by a screw 16B screwed into the panel (FIG. 3) through the axial bore in the setscrew.

As can be also seen in FIG. 1, the lower portion of door 1 includes a longitudinal channel 20. The base wall of channel 20 includes tang 20 which extends beyond the lower edge of the door. Tang 20A includes a perpendicular protuberance 20B having an axial hole. The outer surface of the tang 20A is knurled, toothed or roughened at 20C. The channel 20 is intended to receive a bracket-shaped support 20D which includes a longitudinal slot at 20E. The rear face of support 20D is roughened, toothed or the like to cooperate with the roughened region 20C of the tang 20A. Support 20D can be secured in channel 20 with a screw through the slot 20E into the hole in the protuberance 20B. The purpose of the bracket-shaped support 20D is to support the panel 8 during the mounting operation and to form a stop or support, during the mounting operation, to position the lower edge of the panel and hence the vertical position of panel 8 on door 1 (which, once mounted, can extend beyond the lower side of the door, as is well known). If desired, after the panel installation and adjustment is complete tang 20A, protuberance 20B and bracket 20D can be removed since the panel is fully secured to the door by the screws securing the panel at the adjustable mounting brackets.

Mounting and adjusting the panel 8 on the door does not require the use of templates, reference markings or the application, removal and re-application of the panel to and from the door as is required in prior art adjustable mounting systems.

In order to mount a panel to a door according to this invention first, support 20D is adjusted to the required height and secured to channel 20. Second, the lower edge of the panel 8 is placed on support 20D. Third, panel 8 is horizontally aligned relative to the edge of door 1 and then pressed against the adjustable mounting brackets 10 to engage the double-sided adhesive tape and against the lower adjustable mounting bracket(s) 15 in correct position side to side on door 1. Fourth, the panel 8 is secured to adjustable mounting brackets 10, while held in its correct position by bracket 20D and the double faced adhesive tape, by means of screws inserted through the undercuts 3 and 4 through holes 12A, 13A in the brackets 10 into the panel 8. Fifth, the height of the panel relative to door 1 is adjusted by operating the adjustment cams 9 (operating on the adjustment brackets 10). Sixth, the spacing of panel 8 from the door is adjusted by rotating the screws attached to head 11 rotatably connected to brackets 10.

The lower portion of panel 8 is secured to door 1 by screws passing through the undercuts 5 and the aligned hole in the lower adjustable mounting brackets 15. Last, the distance between the panel 8 and the lower portion of the door is adjusted.

The corner reinforcements 6, 7 can be of polyamide (nylon) filled with glass fibre, set in position and then affixed to the door by known gluing or bonding (for example ultrasonic) methods.

Alternatively, the corner reinforcements can be co-moulded to reduce the number of operations involved in pre-assembling the door in the factory.

We claim:

1. A moulded copolymer door for built-in household electrical appliances to which a panel is to be connected by adjustment means which enables the panel to be adjusted in height, laterally and in depth, said adjustment means including a plurality of adjustable mounting brackets mounted on said door adjacent to undercuts on vertical sides of said door and accessible from the face of said door opposite from said mounting brackets through which said panel may be secured to the adjustable mounting brackets.

2. A door as claimed in claim 1, including corner reinforcements.

3. A door as claimed in claim 2, wherein the corner reinforcements are co-moulded with said door.

4. A door as claimed claim 2, wherein the corner reinforcements are affixed to said door.

5. A door as claimed in claim 2, wherein the corner reinforcements are of glass-reinforced polyamide.

6. A door as claimed in claims 2 through 5 wherein the adjustable mounting brackets are mounted on the corner reinforcements and carry screw means for adjusting the panel in position on said door.

7. A door as claimed in claim 1, wherein the adjustable mounting brackets include a plurality of holes, at least one of said holes being aligned with one of said undercuts.

8. A door as claimed claim 1, wherein said door is moulded of polystyrene.

9. A door as claimed in claim 1, wherein said door includes a guide for a removable and adjustable support for said panel and said guide terminates with a projecting tang provided with a hole for securing said support to said door.

10. A moulded copolymer door for built-in household electrical appliances including a plurality of undercuts on vertical sides of said door;

a panel;

a plurality of adjustable mounting brackets mounted on said door adjacent to said undercuts and having a plurality of paired holes such that at least one pair of holes are aligned with said undercuts; and securing means positioned adjacent said undercuts for securing said panel to said adjustable mounting brackets.

11. A door as claimed in claim 10 wherein said adjustable mounting brackets include screw means for vertical and depth adjusting of said panel on said door.

12. A door as claimed in claim 10 wherein said door includes corner reinforcements and said adjustable mounting brackets are mounted on said corner reinforcements.

13. A door as claimed in claim 10 wherein said adjustable mounting brackets include double faced adhesive tape on a mounting surface of said bracket through which said plurality of paired holes pass for holding said panel in place on said door during installation of said panel.

14. A door as claimed in claim 10 wherein said adjustable mounting brackets include double faced adhesive tape on a mounting surface of said bracket through which said plurality of paired holes pass for holding said panel in place on said door during installation of said panel, and said door includes a guide for a removable and adjustable support adjacent the bottom of the door for support said panel on said door during installation of said panel.

15. A moulded copolymer door for built-in household electrical appliances including a plurality of undercuts on vertical sides of said door, corner reinforcements in the corners of said door, and a guide for a removable and adjustable support adjacent the bottom of the door;

a panel to match adjacent cabinets or furniture;

a plurality of upper adjustable mounting brackets mounted on said door on said corner reinforcements and adjacent to said undercuts; said upper brackets having a plurality of paired holes in a mounting surface arranged such that at least one pair of holes are aligned with said undercuts;

double faced adhesive tape on said mounting surface; and screw means for vertical and depth adjusting of said panel on said door; and securing means positioned adjacent said undercuts for securing said panel to said adjustable mounting brackets.

16. A door as claimed in claim 15 further including one or more lower adjustable mounting brackets mounted on said corner reinforcements and adjacent to said undercuts; said lower brackets having a plurality of holes in a mounting surface arranged such that at least one of said holes is aligned with said undercut; and screw means for depth adjusting of said panel on said door.

17. A moulded copolymer door for built-in household electrical appliances including a plurality of undercuts on vertical sides of said door, corner reinforcements in the corners of said door, and a guide for a removable and adjustable support adjacent the bottom of the door;

a panel to match adjacent cabinets or furniture;

a plurality of upper adjustable mounting brackets mounted on said door on said corner reinforcements and adjacent to said undercuts; said upper brackets having a plurality of paired holes in a mounting surface arranged such that at least one pair of holes are aligned with said undercuts;

double faced adhesive tape on said mounting surface; and and screw means for vertical and depth adjusting of said panel on said door;

one or more lower adjustable mounting brackets mounted on said corner reinforcements and adjacent to said undercuts; said lower brackets having a plurality of holes in a mounting surface arranged such that at least one of said holes is aligned with said undercut; and screw means for depth adjusting of said panel on said door; and securing means positioned adjacent said undercuts for securing said panel to said upper and lower adjustable mounting brackets.

* * * * *